US008662948B2

(12) United States Patent
Motawi et al.

(10) Patent No.: US 8,662,948 B2
(45) Date of Patent: Mar. 4, 2014

(54) BINDING SYSTEM

(76) Inventors: Walid K. Motawi, Ladera Ranch, CA (US); Bryan Dawley, Encinitas, CA (US)

( * ) Notice: Subject to any disclaimer, the term of this patent is extended or adjusted under 35 U.S.C. 154(b) by 229 days.

(21) Appl. No.: 12/932,487

(22) Filed: Feb. 24, 2011

(65) Prior Publication Data

US 2011/0151734 A1 Jun. 23, 2011

(51) Int. Cl.

| | |
|---|---|
| ***A63C 9/00*** | (2012.01) |
| ***A63C 9/04*** | (2012.01) |
| ***A63C 9/24*** | (2012.01) |

(52) U.S. Cl.

USPC ..... 441/70; 280/617

(58) Field of Classification Search

USPC ..... 441/65, 70, 75; 36/11.5, 115, 122–125; 280/611, 617–619, 14.22

See application file for complete search history.

(56) References Cited

U.S. PATENT DOCUMENTS

| | | | | |
|---|---|---|---|---|
| 2,407,556 | A * | 9/1946 | Kleven | 36/12 |
| 2,468,573 | A * | 4/1949 | Rimer | 36/11.5 |
| 2,526,940 | A * | 10/1950 | Fello | 36/11.5 |
| 2,538,170 | A * | 1/1951 | Stritter | 36/16 |
| 2,588,061 | A * | 3/1952 | Vesely | 36/11.5 |
| 3,800,444 | A * | 4/1974 | Young | 36/11.5 |
| 6,637,130 | B2 * | 10/2003 | Urie et al. | 36/11.5 |

* cited by examiner

*Primary Examiner* — Ajay Vasudeva
(74) *Attorney, Agent, or Firm* — X-Patents, APC

(57) ABSTRACT

A binding system comprising a binding upper comprising a plurality of fastening straps affixed to the upper and a substantially rigid binding base comprising a bottom surface for attachment of the fastening straps. The binding base includes a plurality of apertures, wherein one or more of the fastening straps passes through one or more of the apertures and is fastened to the bottom surface of the binding base. In various exemplary embodiments the fastening straps are stapled and/or glued to the bottom surface of the binding base. In various exemplary embodiments the fastening straps attach to the lacing loops on the binding upper or form the lacing loops on the binding upper.

11 Claims, 13 Drawing Sheets

BINDING SYSTEM

FIELD OF THE INVENTION

The present invention is directed to a binding system for use with a board designed for water-based sports activities such as wakeboarding or kiteboarding.

BACKGROUND

In the prior art, various types of bindings are used for floatation devices such as wakeboards. The bindings include various types of boot components to hold a user's foot in place during use. Typical components include heel and toe pieces, one piece boots, overlays, underlays, and the like.

Normally, the boot components are attached to the wakeboard using various types of hardware and fasteners. Referring to FIG. 1, one example of a hardware assembly for a wakeboard 1 is generally designated by the reference numeral 10. Boot components as a toe piece 3 and footbed 5 are illustrated. The toe piece is secured in place by a clamp 7 and fasteners 9, adapted to extend through the clamp and edges 11 of the toe piece to keep it in place. The clamp 7 can take any form, such as a one piece U-shape that would also facilitate attachment of a heel piece as well, or separate members situated on either side of the toe piece for attachment.

The current state of the art for securing the boot components to the wakeboard has been around for a long time, and is cumbersome, bulky, costly, and time consuming for assembly of the wakeboard binding. Thus, a need exists to provide improved ways to attach the boot components of a binding to a wakeboard.

The present invention solves this need by providing a hardware-less binding assembly that eliminates the need for complicated clamping and fastening systems.

SUMMARY OF THE INVENTION

A binding system comprising a binding upper comprising a plurality of fastening straps affixed to the upper and a substantially rigid binding base comprising a bottom surface for attachment of the fastening straps and a plurality of apertures through the binding base, wherein one or more of the fastening straps passes through one or more of the apertures and is fastened to the bottom surface of the binding base. In various exemplary embodiments the fastening straps are stapled and/or glued to the bottom surface of the binding base. In various exemplary embodiments the fastening straps attach to the lacing loops on the binding upper or form the lacing loops on the binding upper. The fastening straps may be made from nylon webbing or other suitable material. In an exemplary embodiment, the bottom surface of the binding base is recessed relative to the peripheral portion of the binding base and may include one or more foam covers that fit within the recessed area. In an exemplary embodiment, the bottom surface of the binding base extends around the periphery of the binding base and wherein there is a substantial opening in the bottom of the binding base, and the fastening straps may extend across the opening in the binding base.

DESCRIPTION OF THE PREFERRED EMBODIMENTS

The inventive binding assembly for a wakeboard offers significant advantages over the prior art binding assemblies. That is, the prior art binding assemblies that use cumbersome and awkward hardware arrangements are eliminated in favor of a simple binding assembly. The inventive assembly is lower cost, lighter weight, and provides a more narrow profile than the prior art arrangements. In addition, the exterior of the binding assembly can be provided with a cleaner, sleeker, and more cosmetically attractive look. This improved exterior appearance translates into an additional selling feature, thus enhancing the sales of the product.

The following description is presented to enable any person skilled in the art to make and/or use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

Figure 1:
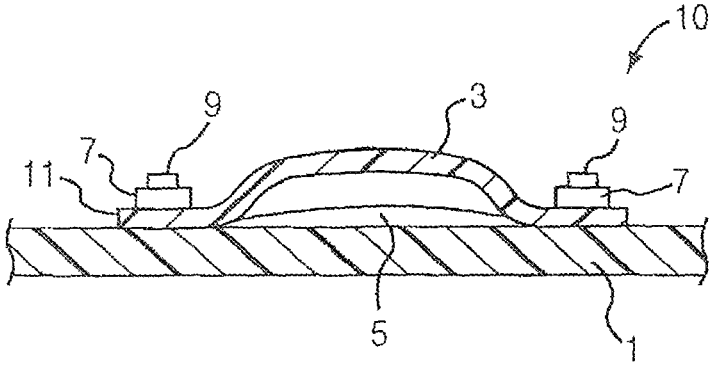
Fig.1 Prior Art
FIG. 1 is a sectional view of a prior art binding assembly.
Figure 6:
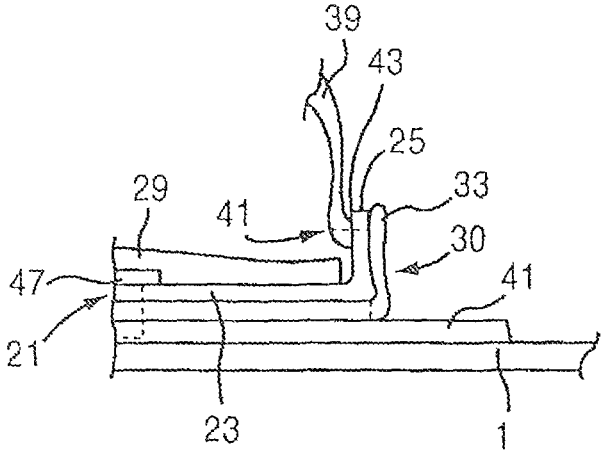
FIG. 6 is a sectional view of the attachment between the first and second components of FIGS. 2 and 3.
Figure 2:
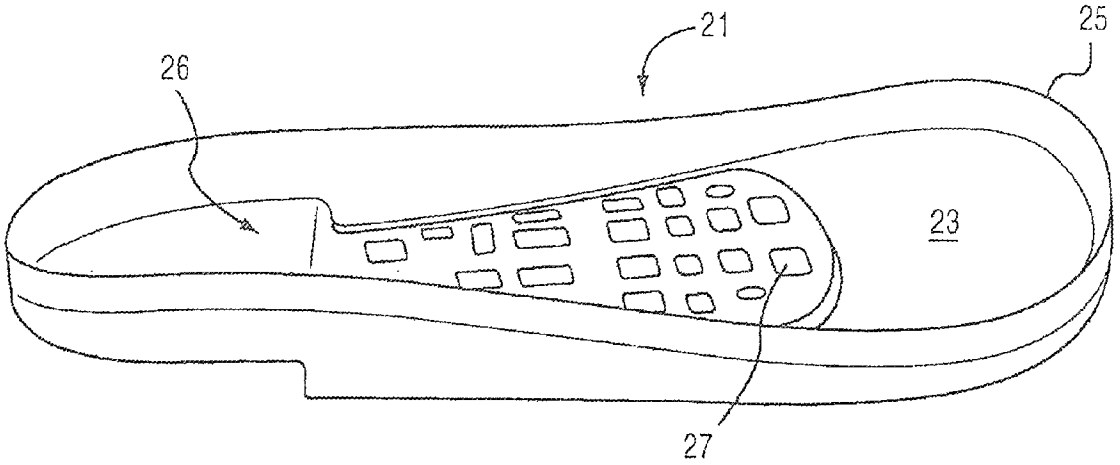
FIG. 2 is a perspective view of one component of one embodiment of the inventive binding assembly.
Figure 3:
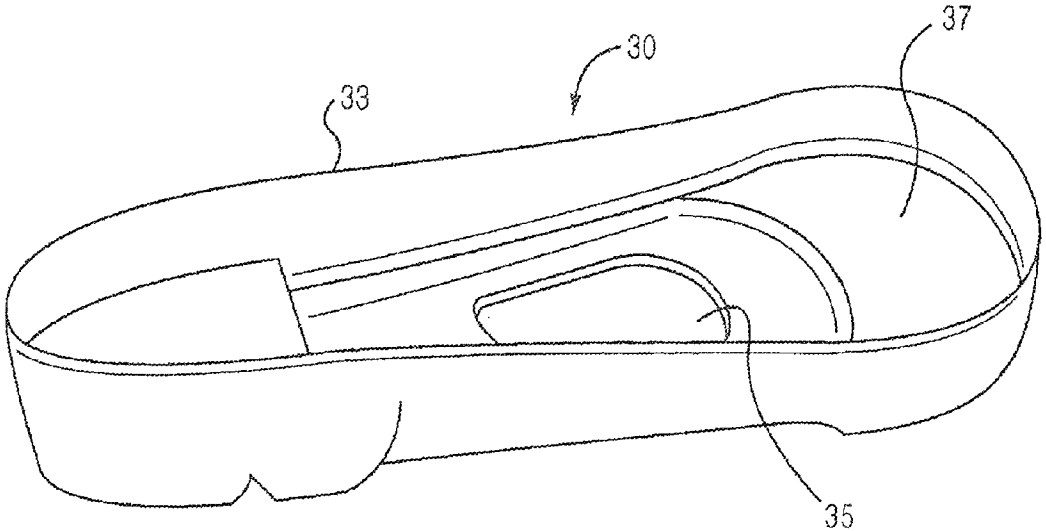
FIG. 3 is a perspective view of a second component of one embodiment of the inventive binding assembly.
Figure 4:
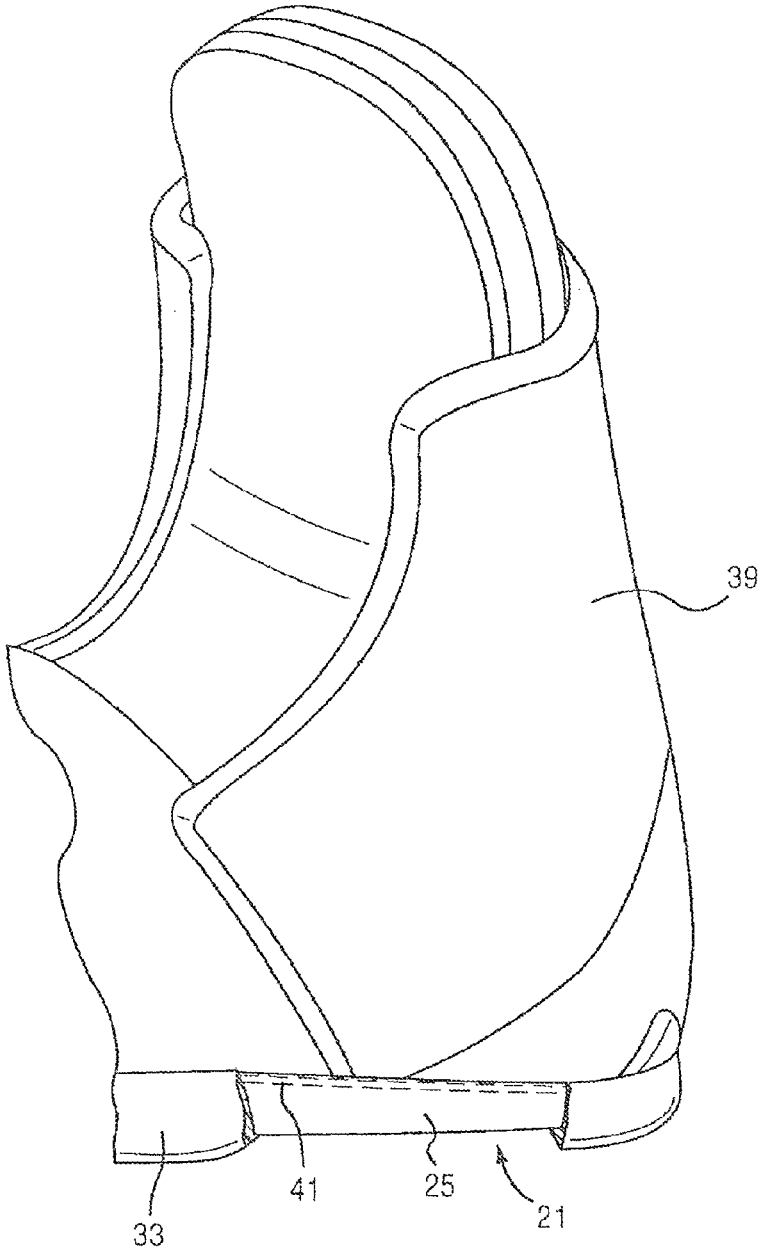
FIG. 4 is a partial view of an assembled binding, showing the attachment between the two binding assembly components of FIGS. 2 and 3.

Referring now to FIGS. 2 and 3, the separated components of the inventive binding assembly are shown. FIGS. 4 and 6 show the components in the assembled state.

FIG. 2 shows one component of the binding assembly as a binding base 21. The base 21 has a bottom 23 and side walls 25. The bottom 23 has openings 27 which allow the base 21 to be mounted onto a wakeboard, either directly or via an intermediate component such as a binding plate. The base bottom 23 and sidewalls 25 form a recess 26 that is configured to accept a footbed 29, see FIG. 6, as part of the binding assembly. It should be understood that the means for attaching the binding base 21 to a wakeboard can be any type depending the particulars of the binding being used. As stated above, the binding base 21 may be adapted to directly attach to the wakeboard, or attach to a binding plate assembly that may allow the binding to be adjusted with respect to the wakeboard. FIG. 6 as described below shows one example of an attachment.

Referring now to FIG. 3, an outersole 30 is depicted which also includes a bottom 31 and a sidewall 33. An opening 35 is shown in a central portion of the bottom to facilitate attachment of the binding base 21 to the wakeboard. The bottom 31 and sidewall 35 form a recess 37 that is sized to receive the binding base. The sidewall 33 is sized in height to cover the sidewall 23 of the binding base 21 for aesthetic purposes as detailed below. When used as shown in FIG. 3, the outersole both surrounds the periphery of the binding base but is also interposed between the base bottom and a surface of the wakeboard, either directly or indirectly.

Referring now to FIGS. 4 and 6, the binding assembly is shown in an assembled state, with a portion of the outersole sidewall 33 removed to show more detail. The assembly includes the binding base 21, the outersole 30, and a binding upper 39 in FIG. 4, and these same components mounted to a wakeboard 1 using a binding plate 41. Binding plates are well known to enhance the attachment of a wakeboard binding to a wakeboard, and a further description is not necessary for understanding of this aspect of the invention. In one mode, the binding plate 41 can allow the binding base 21 to be mounted to the wakeboard 1 in an adjustable fashion if made according to the teachings of U.S. Pat. No. 6,945,837 to Crumrine et al., herein incorporated by reference.

As shown in FIGS. 4 and 6, the binding upper 39 is attached to the sidewall 25 of the binding base using stitching 41 and an adhesive 43 interposed between the binding upper and sidewall 23. The means for attaching the binding base 21 to the binding upper 39 preferably includes both stitching and adhesives to ensure the integrity of the joint between the upper 39 and the binding base sidewall 23. However, any form of attachment can be employed as the means for attaching the binding base to the upper 39, including adhesives, mechanical fastening, stitching, or combinations thereof. Similarly, the outersole 30 can be attached to the binding base 21 in any known fashion, with a preferred method including the use of an adhesive placed between the outer surface of sidewall 25 of the binding base 21 and an inside surface of the sidewall 33 of the outersole 30. FIG. 6 is also representative of the attachment of the binding base 21 to the plate 41 using a fastener 47, although more fasteners could be employed.

It should be understood that the binding upper is intended to encompass any type of binding component that is intended to form an upper part of the binding that surrounds the user's foot. Examples of uppers include toe pieces, heel pieces, overlays, one piece boots, underlays, combinations thereof, and the like. Typically, some part of the upper is attached to the wakeboard or floatation device, but according to the invention, the upper is attached to the binding base, which is in turn secured to the water floatation device in some way.

Referring again to the use of stitching, the extent of the stitching along the sidewall 23 will vary depending on the type of upper being combined with the binding base 21. For example, for a closed toe upper, whether the upper is a one piece construction or combination of heel and toe piece, the stitching can extend around the entirety of the binding base 21 in order to ensure that the upper is adequately attached so that it does not become removed from the base 21. For an open toe upper, the stitching would extend along the sides and heel portion of the binding base 21 and upper. Any type of stitching pattern and/or any number of rows of stitching can be employed as part of the means for attaching the binding base to the upper to achieve the necessary pull strength of the joint. One preferred target pull strength for the attachment is 800 pounds, but this can be greater or less depending on the binding particulars and the type of floatation device being used. One preferred manner of stitching is the use of two rows.

In one method of making the binding assembly, the binding upper is provided, whether in the form of a single piece construction, the combination of components, e.g., an inner boot, overlay, toe and heel pieces, or any other known binding upper construction. Once the upper is provided, the appropriate end is stitched and glued or otherwise fastened to the sidewall 23 of the binding base 21 in a manner consistent with the shape of the upper. The binding base 21 is then inserted into the recess 35 of the outersole 30 so that the outersole 30 covers the attachment of the upper 39 and binding base sidewall 23. Then, the binding base 21 is attached to the wakeboard, either directly or indirectly via a plate assembly or the like.

A footbed can be used as well as part of the assembly process. Typically, the footbed can be glued or otherwise attached in the recess 26 of the binding base 21. When employing the outersole, the footbed is glued prior to attachment of the outersole, and the assembly is then attached to the wakeboard in any known fashion.

Figure 5:
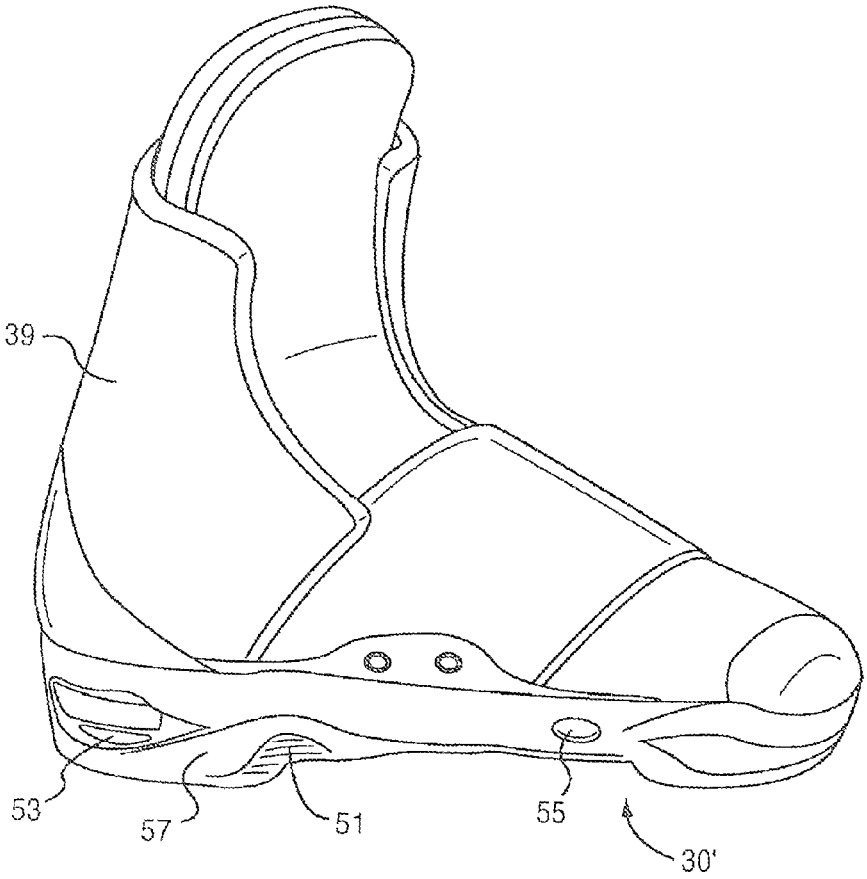
FIG. 5 shows another embodiment of the second component as part of a binding assembly.
Figure 7:
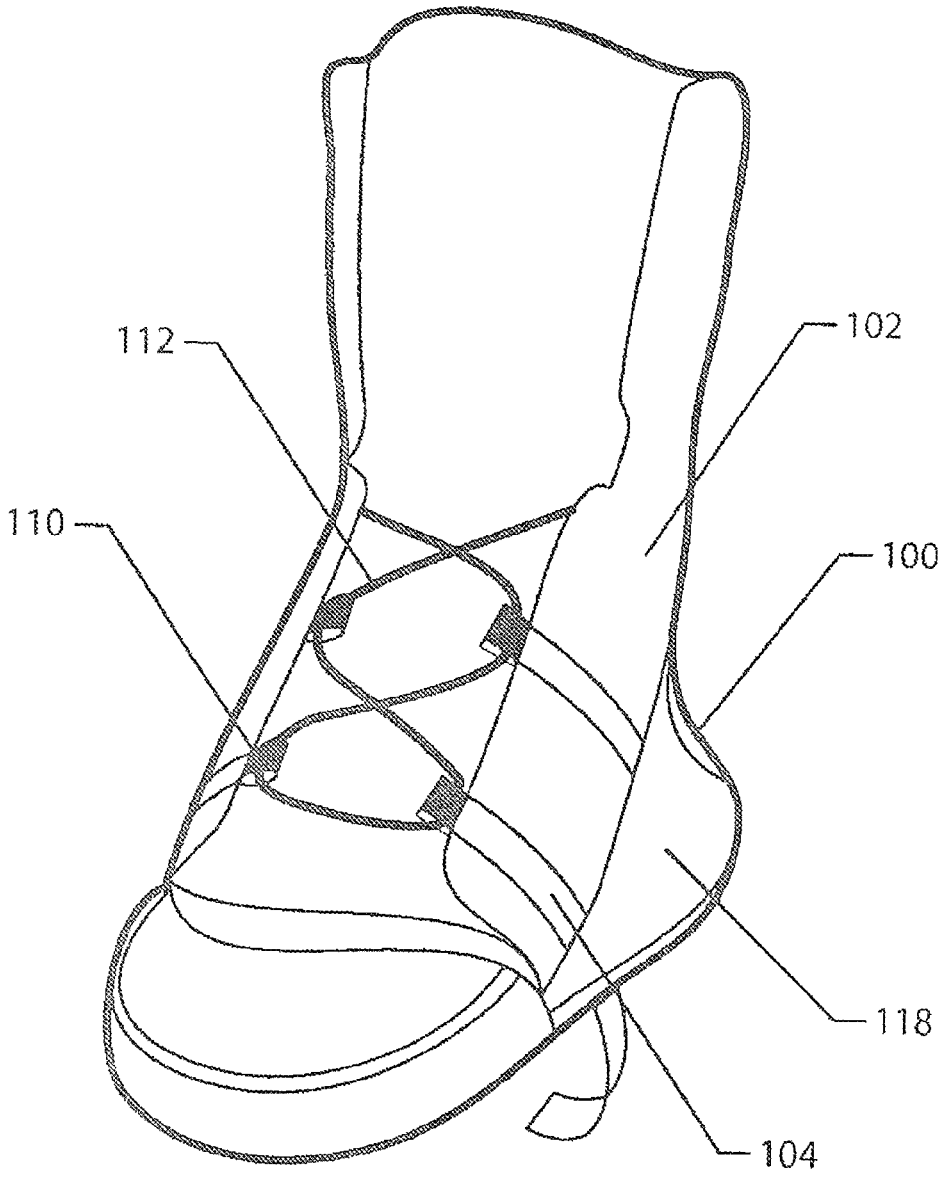
FIG. 7 is a perspective view of an exemplary binding system.
Figure 8:
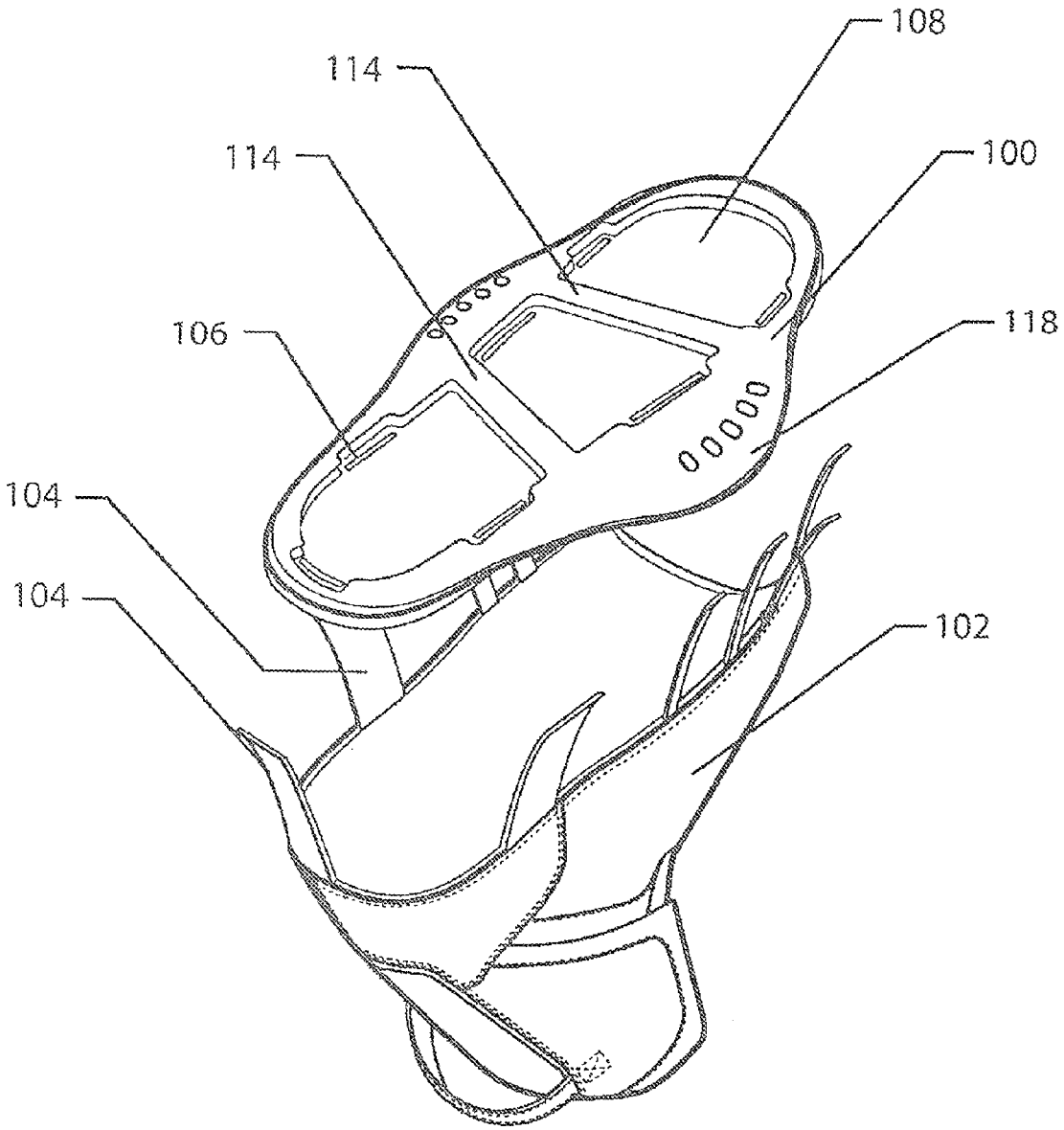
FIG. 8 is an exploded view of an exemplary binding system from the bottom side.
Figure 9:
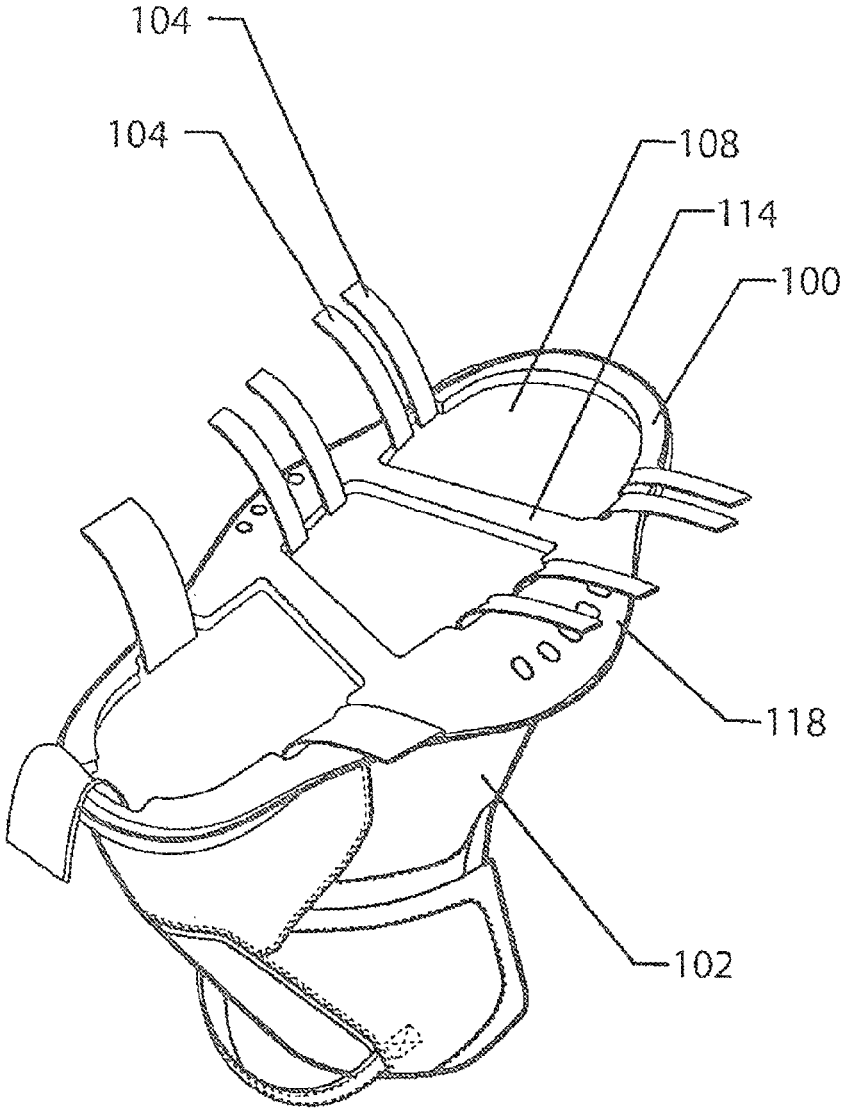
FIG. 9 is a perspective view of a partially assembled exemplary binding system from the bottom side.
Figure 10:
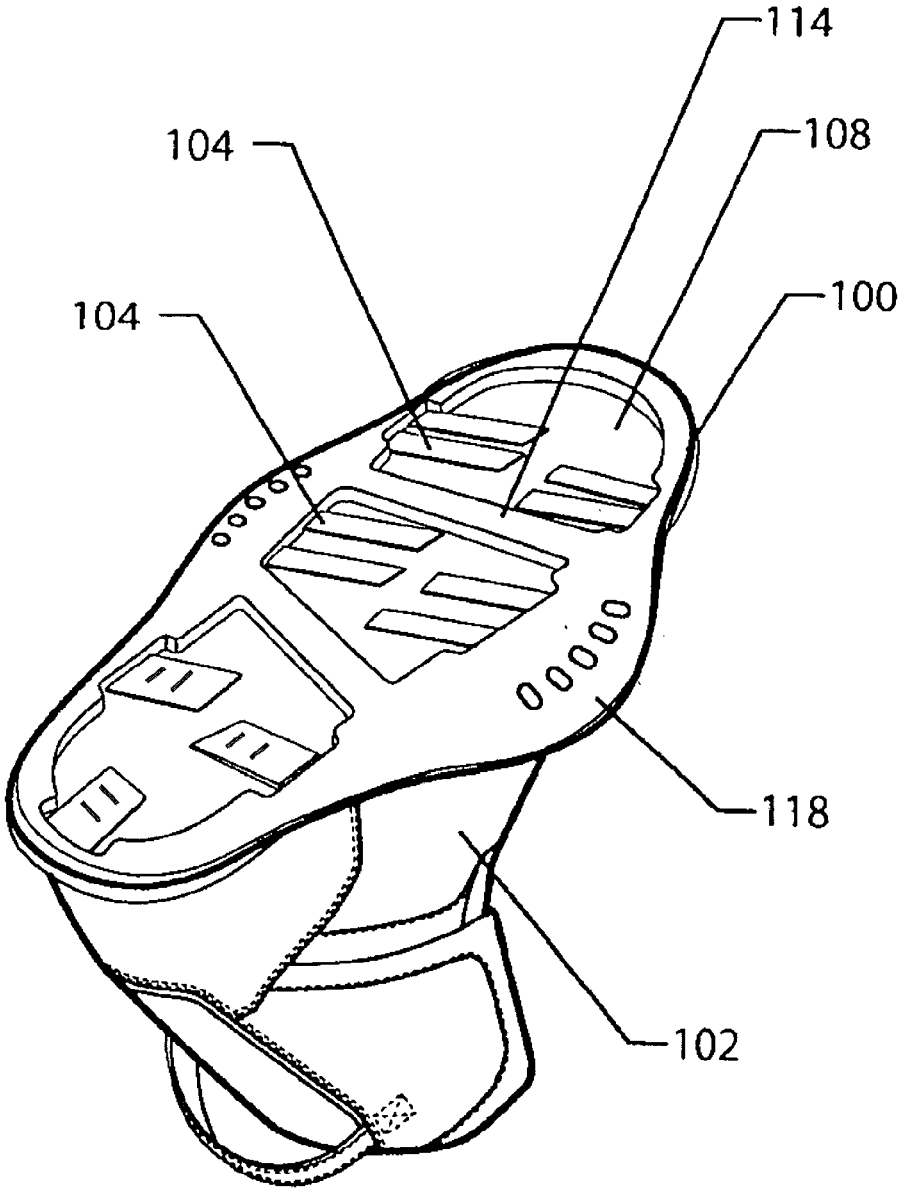
FIG. 10 is a perspective view of a partially assembled exemplary binding system from the bottom side.
Figure 11:
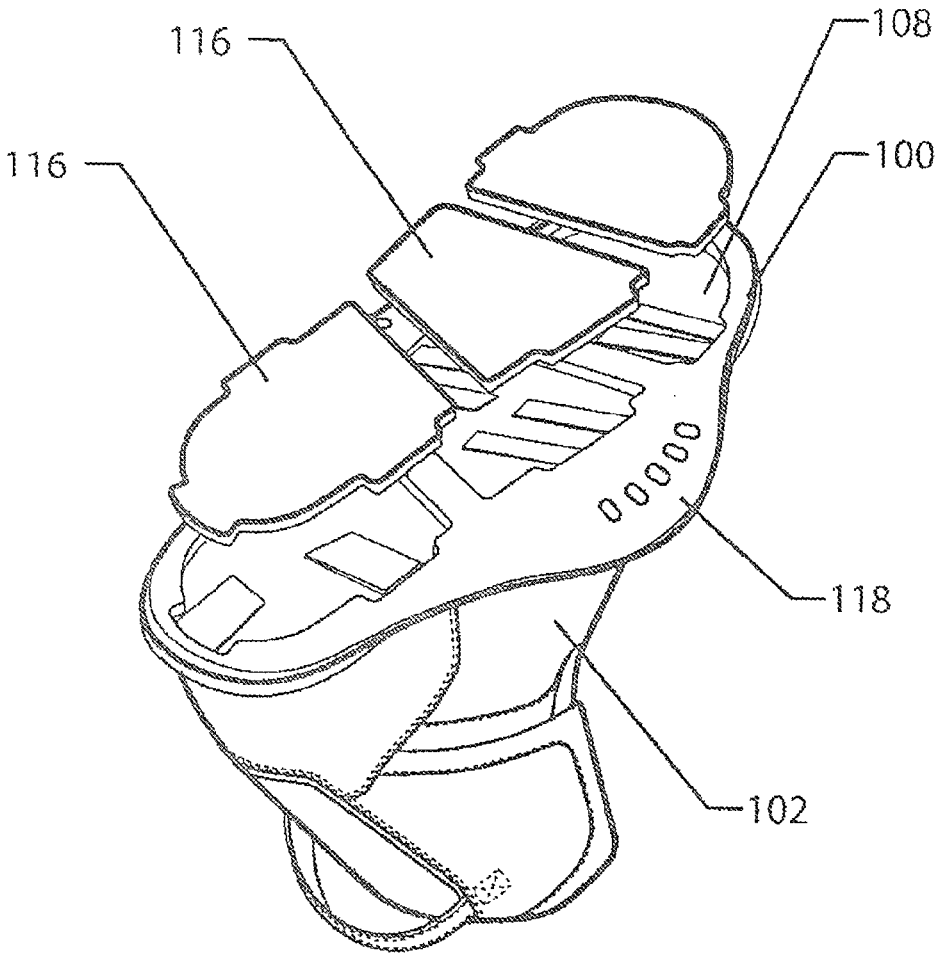
FIG. 11 is a partially exploded view of a partially assembled exemplary binding system from the bottom side.
Figure 12:
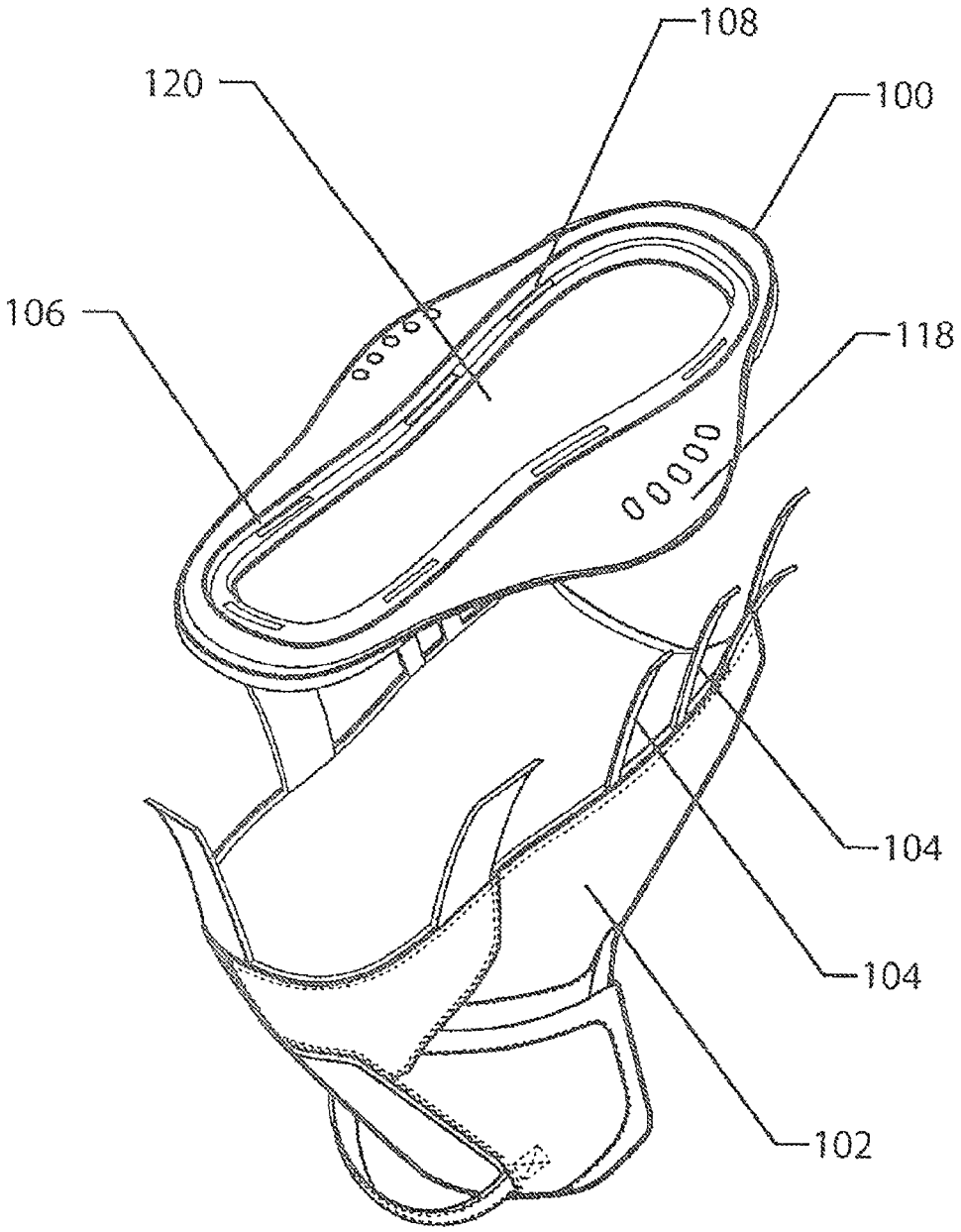
FIG. 12 is an exploded view of an exemplary binding system from the bottom side
Figure 13:
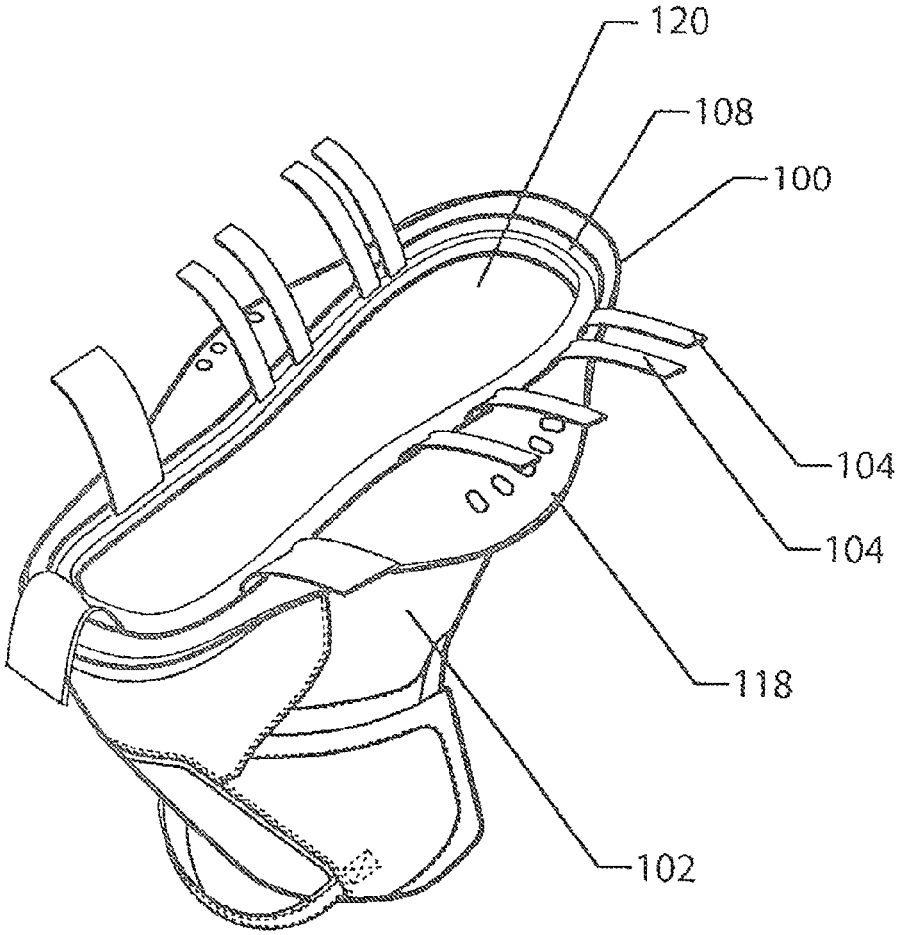
FIG. 13 is a perspective view of a partially assembled exemplary binding system from the bottom side.

While the outersole is shown as part of the preferred embodiment, it is an optional feature since it does not structurally maintain the integrity of the attachment between the binding base and upper. Thus, in certain instances, it may be desirable to only use the binding base to secure the upper of the binding, and leave the area of attachment between the binding base and upper exposed. However, the use of the outersole provides a more cosmetically pleasing binding. That is, the outersole can be made in various shapes and colors, and with various markings or logos so as to give the binding assembly a unique identity. In this regard, FIG. 5 shows another style of outersole designated as reference numeral 30'. This outersole includes features such as ridges 51, a recess 53, a logo 55, a protruding part 57, and the like to make it more cosmetically pleasing and identifiable.

While the outersole is shown with an opening in the bottom to allow for attachment of the binding base to the wakeboard, it could have other configurations to hide the attachment joint between the binding base and upper. For example, the outersole could take the form of just the sidewall 33, e.g., a strip that would surround the binding base and be devoid of a bottom that is positioned between the base and the wakeboard as shown in FIG. 6. Alternatively, the bottom of the outersole could be continuous with any fasteners used for attachment of the binding base to the wakeboard penetrating the material of the outersole rather than passing through an opening in the outersole bottom.

The binding base and outersole can be made of any material that would be appropriate for use in a water floatation device, including polymers, metals, composites, or combinations thereof. Preferably, the base binding is metal to provide the necessary pull strength, and the outersole is a polymer material allowing it to be molded or made into various shapes, colors, etc. A more preferred material for the binding base is a high strength glass-filled nylon since it combines strength, light weight, and the ability to be stitched through.

Referring now to FIGS. 7 through 11, in a further exemplary embodiment, the binding assembly includes a binding base 100 and a binding upper 102 that is attached to the binding base 100 by a plurality of fastening straps 104 that extend from the binding upper 102, through one or more apertures 106 in the binding base 100. The binding base 100 can be made from any suitable relatively rigid material, including various polymers or metal. The fastening straps 104 are then fastened to a surface 108 on the underside of the binding base 100. The fastening straps 104 may be fastened to the surface 108 by any known fastening system including staples, tacks, screws, nails, adhesives, welding, plastic spikes, etc. or any combination of such fastening systems.

The fastening straps 104 can be manufactured from any suitable material such as nylon webbing and may be sewn into or otherwise attached to the binding upper 102. In an exemplary embodiment, the fastening straps extend upward along or through the binding upper 102 and connect to the loops 110 used for the binding laces 112. The fastening straps 104 may also be used to form the loops 110 used for the binding laces 112.

The binding base 100 can be designed in a wide range of configurations depending on various considerations such as cost and performance. As seen most clearly in FIGS. 8 through 11, in an exemplary embodiment binding base 100 includes a plurality of integrated recessed surfaces 108 on its underside. These surfaces 108 are separated by structural crossbars 114. During assembly, each of the fastening straps 104 is passed through an aperture 106, then wrapped across the adjacent surface 108 where it is fastened to the surface 108 as described above by a fastening system such as tacks and adhesive.

In order to facilitate the adherence of the fastening straps 104 to the surfaces 108, a layer of material such as a fabric or simulated leather can first be applied to the surfaces 108. Fitted covers 116 made from foam or any other suitable material can then be placed over the recessed surfaces, providing a clean appearance and a smooth bottom surface for the overall binding assembly. The binding assembly can then be removably attached to the surface of the board using a bolt located on the underside of the binding base 100 that extends upward through an attachment flange 118 on the binding base 100, or by any other known attachment system.

It will be readily understood that the configuration of binding base 100 can be modified to provide for a single contiguous surface 108 for attachment of the fastening straps, or for a plurality of such surfaces 108. Similarly, the number and placement of the fastening straps 104 can be varied and adjusted to obtain particular design characteristics.

Figure 14:
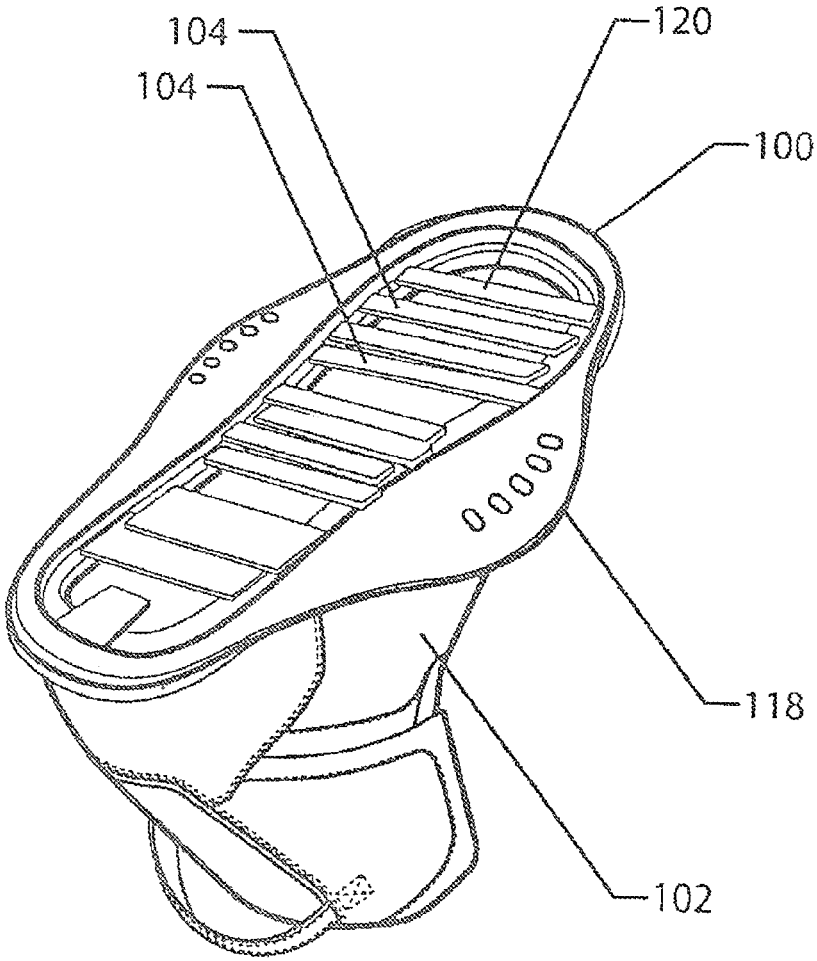
FIG. 14 is a perspective view of a partially assembled exemplary binding system from the bottom side.
Figure 15:
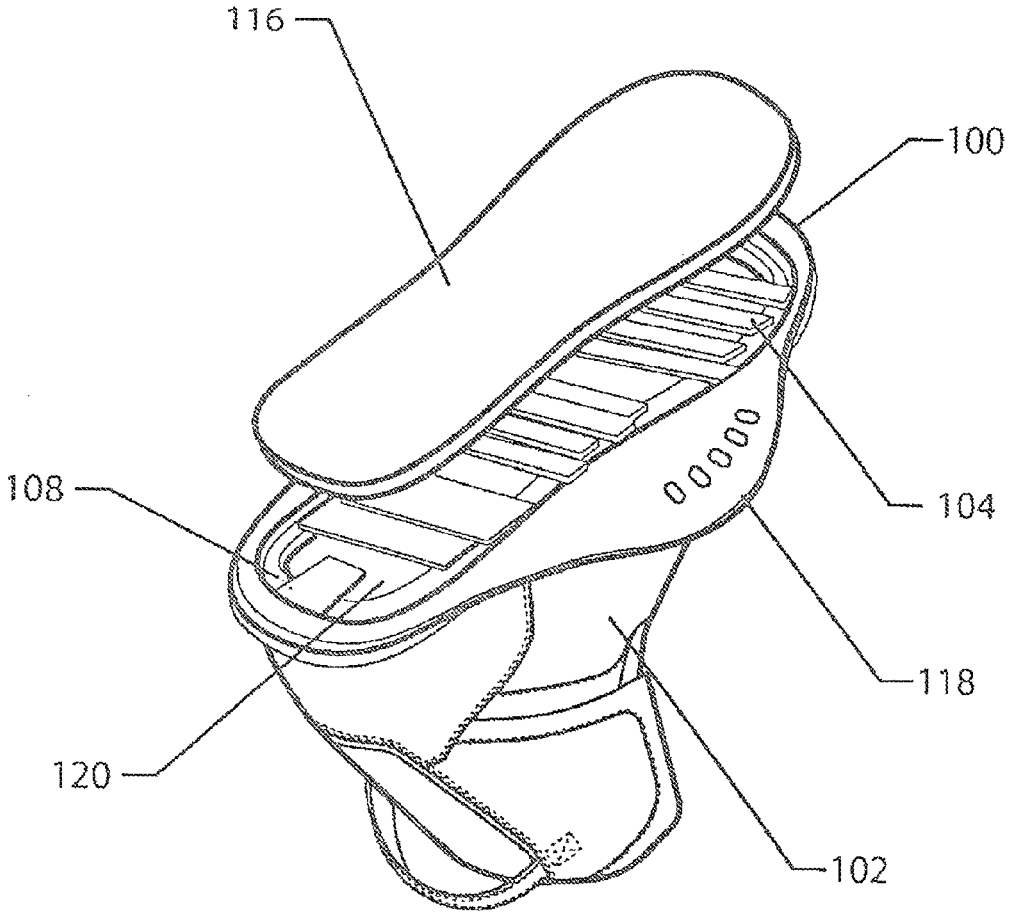
FIG. 15 is an exploded view of an exemplary binding system from the bottom side.

Referring to FIGS. 12 through 15, in an exemplary embodiment, the surface 108 used for attaching the fastening straps 104 on the underside of the binding base 100 may extend only around the periphery of the binding base, leaving a substantial opening 120 in the binding base. The fastening straps 104 may extend down through the apertures 106 and attach directly to the adjacent portion of surface 108, or as shown in FIG. 14, the fastening straps may extend across the opening 120 in the binding base 100 and also attach to the surface 108 on the opposite periphery of the binding base 100.

The invention is also advantageous in that airpacks or other conventional shoe cushioning devices or technology can be more easily utilized with the binding plate and upper attachment.

While the invention is particularly described for use with wakeboards and kiteboards, it is believed that the binding assembly could be adapted for any floatation device for a fluid such as water, or a solid such as snow, or sand. For purposes of this application, snow, sand and water are grouped together under the definition of a fluid when describing the type of floatation device adaptable for use with the invention.

As such, an invention has been disclosed in terms of preferred embodiments thereof which fulfills each and every one of the objects of the present invention as set forth above and provides a new and improved wakeboard binding assembly, and its method of assembly.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A binding system for a wakeboard comprising:

a binding upper having a lace closure system, comprising a plurality of fastening straps affixed to the upper and extending therefrom; and a rigid binding base comprising a bottom surface for attachment of the fastening straps and having a plurality of apertures through the binding base, and one or more flanges extending laterally from the binding base, the flanges having holes for use in fastening the binding base to a wakeboard;

wherein the fastening straps passes through one or more of the apertures and are fastened to the bottom surface of the binding base.

2. The binding system of claim 1, wherein the fastening straps are stapled to the bottom surface of the binding base.

3. The binding system of claim 1, wherein the fastening straps are glued to the bottom surface of the binding base.

4. The binding system of claim 1, wherein the fastening straps are stapled and glued to the bottom surface of the binding base.

5. The binding system of claim 1, wherein the fastening straps attach to one or more lacing loops on the binding upper.

6. The binding system of claim 1, wherein the fastening straps form one or more lacing loops on the binding upper.

7. The binding system of claim 1, wherein the fastening straps are made of nylon webbing.

8. The binding system of claim 1, wherein at least a portion of the bottom surface of the binding base is recessed relative to the peripheral portion of the binding base.

9. The binding system of claim 8, further comprising a foam cover that fits within the recessed portion of the bottom surface of the binding base.

10. The binding system of claim 1, wherein there is a substantial opening in the bottom of the binding base.

11. The binding system of claim 10, wherein the fastening straps extend across the opening in the bottom of the binding base.

* * * * *